US006845885B2

(12) United States Patent
Morgenroth

(10) Patent No.: US 6,845,885 B2
(45) Date of Patent: Jan. 25, 2005

(54) POURING SPOUT FOR A LIQUID CONTAINER

(75) Inventor: Ingolf Morgenroth, Martinroda (DE)

(73) Assignee: Mauser-Werke GmbH & Co. KG, Brül (DE)

( * ) Notice: Subject to any disclaimer, the term of this patent is extended or adjusted under 35 U.S.C. 154(b) by 0 days.

(21) Appl. No.: 10/265,828

(22) Filed: Oct. 7, 2002

(65) Prior Publication Data

US 2003/0034363 A1 Feb. 20, 2003

Related U.S. Application Data

(63) Continuation of application No. PCT/EP01/04256, filed on Apr. 12, 2001.

(30) Foreign Application Priority Data

Apr. 14, 2000 (DE) ..... 100 18 495
Oct. 17, 2000 (DE) ..... 100 51 336

(51) Int. Cl.[7] ..... B67D 1/016
(52) U.S. Cl. ..... 222/109; 222/464; 222/479
(58) Field of Search ..... 222/109, 153.01, 222/478, 479, 464, 522, 481.5, 484, 153

(56) References Cited

U.S. PATENT DOCUMENTS 2,812,120 A * 11/1957 Beall ..... 222/481.5
3,361,307 A 1/1968 Clare
3,658,218 A * 4/1972 Krautkramer ..... 222/522
4,193,524 A * 3/1980 Fleming ..... 222/484
4,509,665 A * 4/1985 Goodall ..... 222/478
4,705,192 A 11/1987 Knapton
4,781,313 A * 11/1988 Verheyen ..... 222/464
5,002,209 A * 3/1991 Goodall ..... 222/479
5,199,613 A * 4/1993 Magrath et al. ..... 222/153
5,377,882 A * 1/1995 Pham et al. ..... 222/479

FOREIGN PATENT DOCUMENTS

| | | | |
|---|---|---|---|
| AT | 313 092 | 5/1973 | |
| AT | 317 019 | 6/1974 | |
| CH | 534 076 | 4/1973 | |
| DE | 2356685 | 5/1974 | |
| DE | 76 27 733 | 1/1977 | |
| DE | 8701056 | 6/1987 | |
| DE | 87 01 056 | 7/1987 | |
| DE | 3919455 A1 * | 12/1989 | ..... B65D/25/40 |
| DE | 296 05 112 U1 | 7/1996 | |
| DE | 29720426 | 5/1998 | |
| EP | 0 047 757 | 3/1982 | |
| EP | 0 677 445 | 10/1995 | |
| FR | 20986444 | 3/1972 | |
| JP | 63-229670 | 3/1990 | |
| WO | WO 00 56619 | 9/2000 | |

* cited by examiner

*Primary Examiner*—Gene Mancene
*Assistant Examiner*—Melvin A. Cartagena
(74) *Attorney, Agent, or Firm*—Henry M. Feiereisen

(57) ABSTRACT

A pouring spout for liquid containers to allow for a dosed and continuous ventilation of the container interior and thus a regular pouring of the liquid independent of the degree of tilt of the container, includes a ring-shaped upper part and a tubular segment attached to the ring-shaped upper part and having at least one ventilation opening through which the air enters in a dosed manner. Provided in the lower part of the tubular segment is a partition which extends on an inner side of the tubular segment in substantial parallel relationship to the tubular segment and is connected laterally with the tubular segment. The partition wall has an upper part distal bottom wall for connection to the tubular segment to form a so-called air trap.

19 Claims, 3 Drawing Sheets

POURING SPOUT FOR A LIQUID CONTAINER

CROSS-REFERENCES TO RELATED APPLICATIONS

This application is a continuation of prior filed copending PCT International application no. PCT/EP01/04256, filed Apr. 12, 2001, which was not published in English and which designated the United States and on which priority is claimed under 35 U.S.C. §120, the disclosure of which is hereby incorporated by reference.

This application claims the priority of German Patent Applications, Ser. No. 100 18 495.2, filed Apr. 14, 2000, and 100 51 336.0, filed Oct. 17, 2000, pursuant to 35 U.S.C. 119(a)–(d), the disclosure of which is incorporated herein by reference.

BACKGROUND OF THE INVENTION

The present invention relates to a pouring spout for liquid containers with a ring-shaped upper part, which is insertable in the pouring opening or the pouring neck of a liquid container.

It is desirous to pour a liquid stream evenly when manually pouring liquid from containers to prevent the unwanted sloshing of the liquid. Bottles, canisters, Fassets®, barrels or similar containers are hereby considered as containers for temporary storage of liquids. A pouring with even liquid stream requires a proportionate venting of the container interior during the pouring process—in accordance with the discharged liquid volume. As a consequence of undefined streams of the discharged liquid or/and through "pumping" (=discontinuous breathing), the continuous venting is frequently interfered with, resulting in the uncontrolled sloshing of liquid.

The prior art to EP 0 677 445A1 discloses a container with venting channel for transport of liquids and having a venting pipe as integral part of the canister. This canister has, however, the drawback that is can be produced only with complicated tools and is subjected to substantial distortion as a consequence of widely different shrinkage strains. Other embodiments of conventional pouring spouts are described in the publications JP 63-229 670, EP 0 047757 as well as AT-PS 313092. They suffer shortcomings because a portion of the pouring spouts projects vertically into the opening of the liquid container and is significantly bent to the side. As a result, the liquid container requires a particular tilting angle until these systems can become effective. In particular during the initial phase, when a precise pouring stream should be realized, these systems are insufficient. Moreover, a machine-based insertion of such pouring spouts is complicated because the venting pipe is curved and therefore requires a deflection of the direction of insertion.

Another approach, proposed in the utility model DE 297 20 426 U1, has the drawback of requiring an additional lateral venting pipe, in particular when the opening of the liquid container has a greater diameter, in order to realize the desired effect.

It would therefore be desirable and advantageous to provide an improved pouring spout for liquid containers which obviates prior art shortcomings and enables a steady venting of the container interior substantially independent from the tilting position of the container to thereby realize an even pouring of the liquid and which can also be placed by machine into the container opening in a very simple manner.

SUMMARY OF THE INVENTION

According to one aspect of the present invention, a pouring spout for a liquid container, includes a ring-shaped upper part for placement in a pouring neck of a liquid container; a tubular segment attached to the ring-shaped upper part and extending approximately in prolongation of the ring-shaped upper part downwards into the pouring neck, with the tubular segment having at least one opening for permitting air to enter; and a partition wall extending on an inner side of the tubular segment in substantial parallel relationship to the tubular segment and connected laterally with the tubular segment, with the partition wall having an upper part distal bottom wall for connection to the tubular segment.

The pouring spout according to the invention is generally inserted perpendicularly into the pouring opening of the container and includes on the side in opposition to the pouring opening a closed back wall with two (at least, however, one) opening for air to enter in a dosed manner.

A partition wall, which extends in pouring direction substantially parallel to the back wall and reaches up to the lower edge of the pouring neck and which forms with its lower end together with the back wall a bottom, which includes at least one opening, preferably, however, two or more openings for air to enter in a dosed manner, defines together with the back wall and the bottom a so-called "air trap".

The pouring spout is so configured that the attached partition wall prevents the presence of liquids streams at the ventilation openings so that especially a suction effect is closed at these locations. The ventilation openings provided at the pouring spout are so provided that air can be drawn in through at least one opening in a dosed manner in dependence on the tilting angle, while outpouring liquid can still flow through the unused openings and is united at the upper end of the attached partition wall with the main pouring stream.

As a result of the openings formed in the back wall and at the bottom of the pouring spout, air can reach the interior to be vented only in a controlled manner thereby preventing a sloshing of liquid.

Shape (e.g. bore, oblong hole or slot) and size (diameter and length) of the various ventilation openings, provided in the pouring spout, can be freely configured and can be selected in dependence on the diameter of the opening port of the container and the hereby accompanying maximum pouring amount of liquids per time unit.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
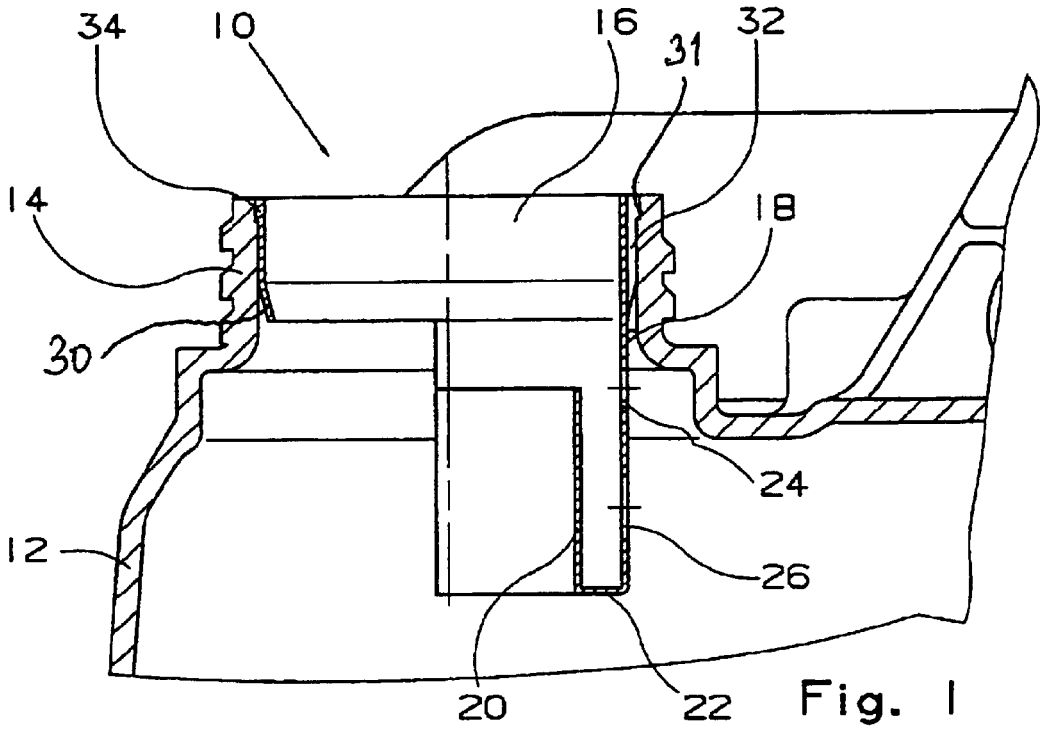
FIG. 1 is a vertical section of a first embodiment of a pouring spout according to the invention, inserted in a canister.

Throughout all the Figures, same or corresponding elements are generally indicated by same reference numerals.

Turning now to the drawing, and in particular to FIG. 1, there is shown a pouring spout according to the invention, generally designated by reference numeral 10 and inserted in a pouring neck 14 of a canister 12. The pouring spout 10 is made as injection-molded plastic part of HD-PE and includes a ring-shaped upper part 16 for connection to a downwardly directed tubular segment 18. The tubular segment 18 has a slightly smaller diameter than the upper part 16 and extends in circumferential direction approximately over a length of phi times radius (ϕ×r=semicircle; half pipe). The tubular segment 18 may, however, also be configured as a fully circulatory tube. The overall length of the pouring spout 10 (upper part 16 and tubular segment 18) is a slightly longer or greater than the outer diameter of the upper part 16 so as to establish a length/diameter ratio of about 1, or slightly greater than 1.

Figure 2:
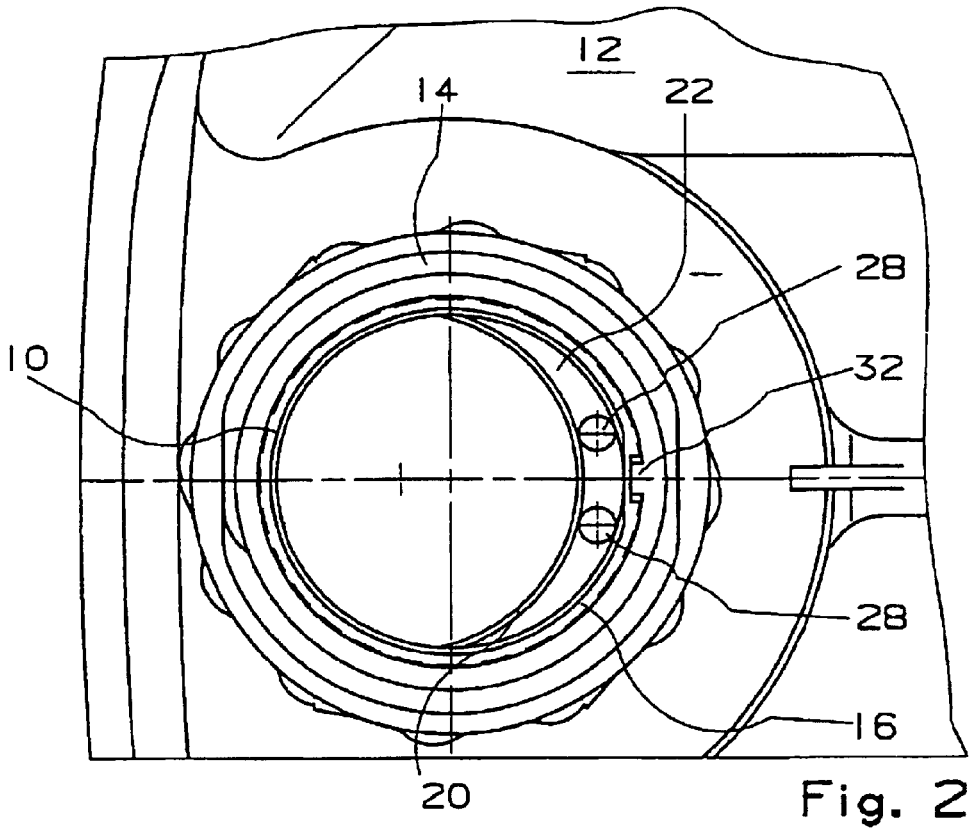
FIG. 2 is a top view of the pouring spout of FIG. 1.

Arranged on the inside of the tubular segment 18 is a curved partition wall 20 in parallel relationship, which is secured laterally to the tubular segment 18. This construction is clearly seen in the top view of FIG. 2.

On the side facing away from the upper part 16, the inner partition wall 20 is connected via a sickle-shaped bottom wall 22 with the outer tubular segment 18 so as to define in-between a so-called "air trap". Formed in the wall of the outer tubular segment 18 are two ventilation openings 24,26 which are positioned above one another in axial direction. Furthermore, two ventilation openings 28 are arranged in the bottom wall 22.

A slightly conical gradation 30, which is located between the ring-shaped upper part 16 and the tubular segment 18, enables to insert the pouring spout 10 with a certain predetermined pressure into the pouring neck 14 of the canister so that a press fit ensures a secure hold of the pouring spout 10 and renders a detachment during pouring of the canister 12 impossible.

In order to prevent a turning of the pouring spout 10 in the pouring neck 14, e.g. through shaking during transport, the pouring spout 10 is equipped with an anti-rotation device 32. Hereby, the upper part 16 of the pouring spout 10 is formed with an external elongated slot (dimple) and the pouring spout 14 is formed with a complementary projection to render a turning impossible. Furthermore, the pouring spout 10 is also provided with a push-in inhibiting mechanism 34 which is arranged at the upper outer edge of the upper part 16 and configured as narrow, radially outwardly projecting flanged rim received in a complementary recess 31 of the pouring neck 14.

The rear wall of the tubular segment 18 ensures together with the partition wall 20, which reaches approximately to the lower edge of the pouring neck 14 of the container, that air being drawn-in can enter the container in a controlled manner via the upper ventilation opening 24 in the tubular segment 18 during the first pouring stage, i.e. the pouring stage at a slight tilted disposition of the container, so that a very slow pouring can be realized at high accuracy of the pouring stream, when the canister is full.

In this first pouring stage, a small amount of liquid is able to flow through the lower ventilation opening 26 via the inner side of the partly closing partition wall 20 to the pouring stream, without adversely affecting the aspirated air at the upper ventilation opening 24.

When further tilting the container to thereby pour more liquid, the second stage of the pouring spout 10, the so-called normal pouring stage, becomes effective and air is now able to enter also through the lower greater ventilation opening 26 in the tubular segment 18 into the interior space of the container.

During this pouring stage (tilting angle about 90° and further feeding), some liquid to be poured flows through the ventilation openings 28 in the sickle-shaped bottom wall 20 via the inner side of the partly closing partition wall 20 into the pouring stream and is united therewith.

The provision of a lateral or outwardly offset arrangement of the bottom-side ventilation openings 28 in relation to the ventilation opening 26 prevents the ventilation opening 26 to adversely affect the air stream. The ventilation openings 28 are provided at a right angle to the ventilation openings 24, 26. Thus, a steady venting of the container interior space in dosed manner is hereby ensured from a tilting angle of 90 degrees so that the effective cross sections of the bottom-side ventilation openings 28 increase to the same extent as a decrease of the effective cross section of the ventilation opening 26, when the tilting angle increases. Depending on requirement, e.g. two ventilation openings 28 with greater bore diameter or four ventilation openings with respective or/and smaller diameter can be provided in the sickle-shaped bottom wall 22.

As of a tilting angle of about 120°, the third pouring stage, the so-called extreme pouring stage, becomes effective. Air to be drawn is now able to flow also through the lowermost two or four ventilation openings 28 into the canister.

The ventilation openings are hereby so dimensioned that for the one used for pouring from the canister no or hardly noticeable transition from one into the other pouring stage is ensured. The ventilation openings act respectively in reverse sequence, when the tilting angle is reduced up to a stoppage of the pouring process.

Figure 3B:
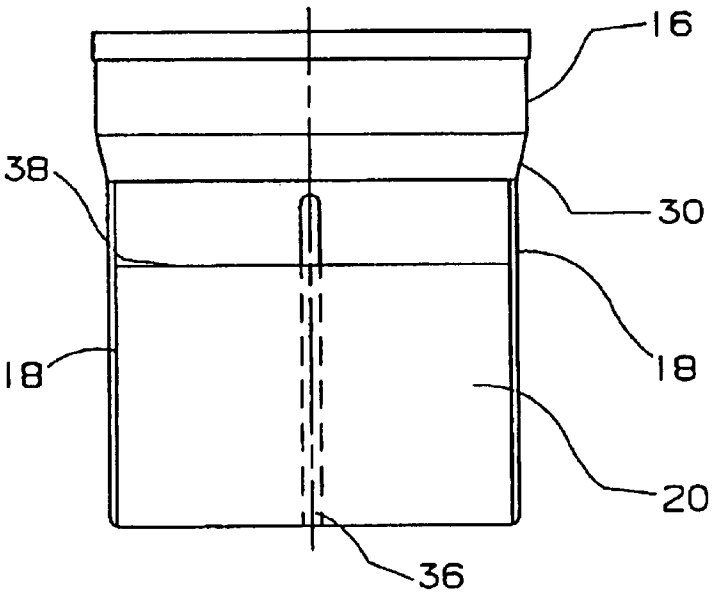
FIG. 3*b* is a side view of the pouring spout of FIG. 3*a;*
Figure 3A:
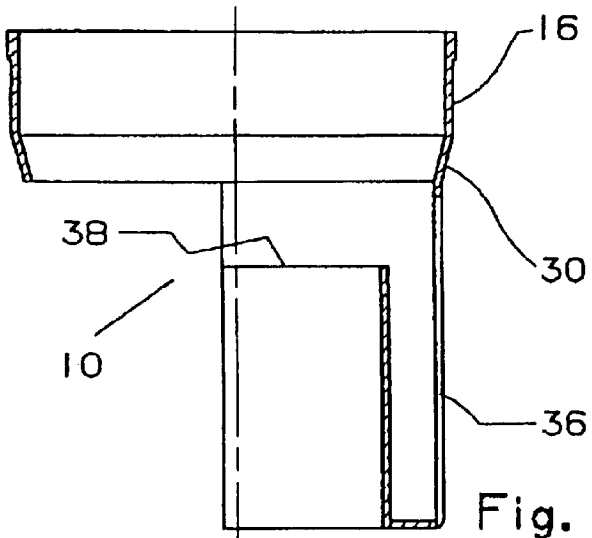
FIG. 3*a* is a longitudinal section of a second embodiment of a pouring spout according to the invention with slotted back wall.
Figure 3C:
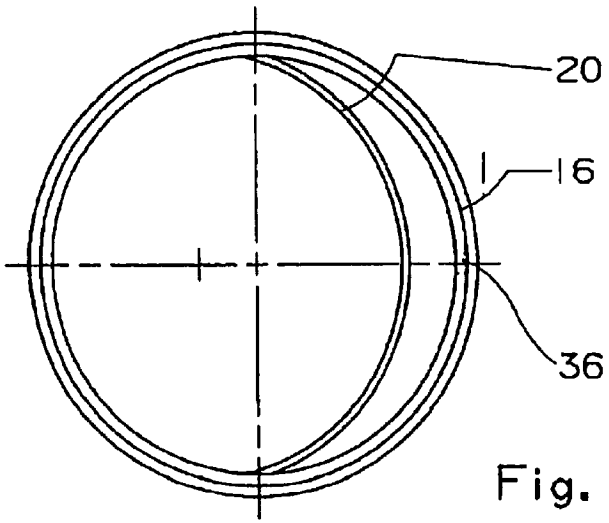
FIG. 3*c* is a top view of the pouring spout of FIG. 3*a;*

The embodiment shown in FIGS. 3*a*, 3*b* and 3*c* includes, instead of the two superimposed ventilation bores in the tubular segment 18, a vertical narrow vent slot 36 which extends upwards beyond the upper edge 38 of the partition wall 20 almost to the conical gradation 30 and downwards up to the sickle-shaped bottom wall 22. The operation of this embodiment corresponds to the manner illustrated in FIGS. 1 and 2.

Figure 4B:
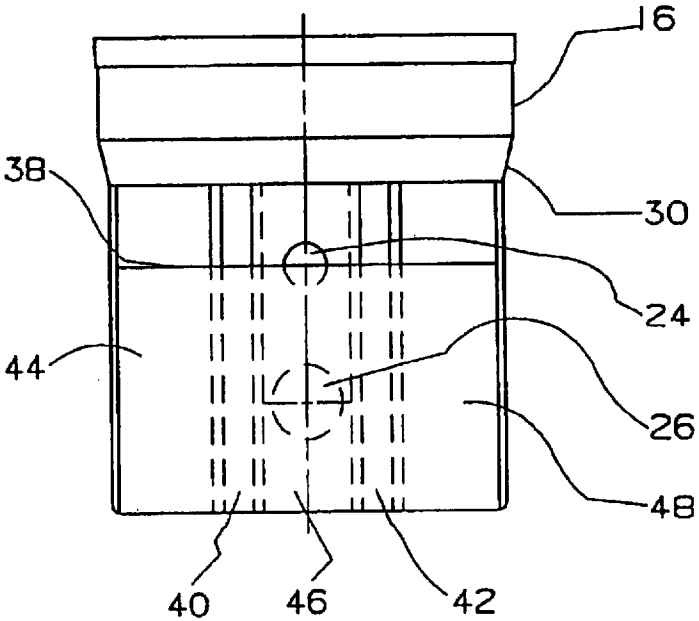
FIG. 4*b* is a side view of the pouring spout of FIG. 4*a*.
Figure 4A:
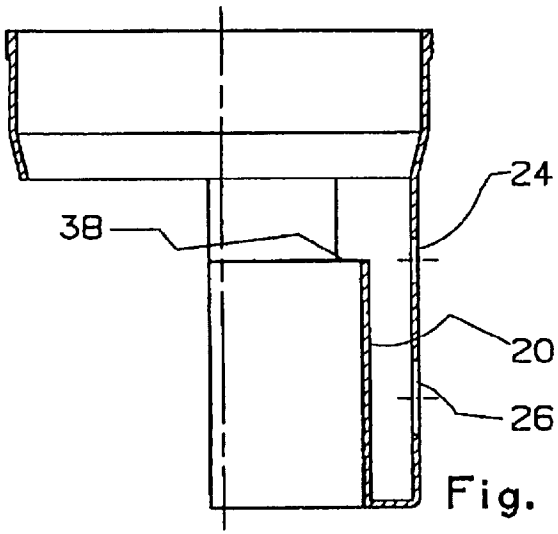
FIG. 4*a* is a longitudinal section of a third embodiment of a pouring spout according to the invention with several air chambers.
Figure 4C:
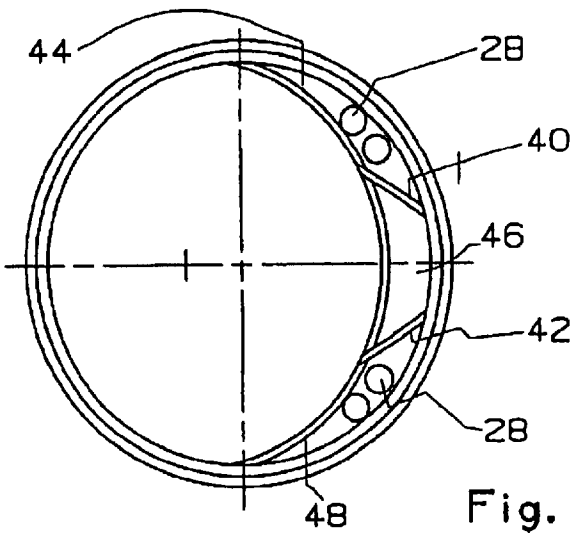
FIG. 4*c* is a top view of the pouring spout of FIG. 4*a*.

A further advantageous embodiment, in particular for containers with great diameter of the pouring neck (greater 45 mm), is illustrated in FIG. 4*a*, FIG. 4*b* and FIG. 4*c*. Hereby, the sickle-shaped "air trap" is subdivided by two vertical intermediate walls 40 and 42 into three chambers 44, 46 and 48.

During "extreme pouring", it is required to so dimension the effective air column of the pouring spot that a continuous venting of the container is realized even in this severely tilted position of the container. Hereby, a prolongation of the total installation length is normally required. The embodiment shown in FIG. 4 enables an increase of the necessary effective air column corresponding to the height difference of the chambers 44 and 48 in relation to the chamber 46, without changing the total installation length of the pouring spout. The operation of this embodiment corresponds to the pouring spout shown in FIG. 1.

Listing of Important Features Essential to the Invention:

- the upper edge of the partition wall of the pouring spout extends to the lower edge of the pouring neck of the container, when installed;
- the pouring spout is equipped with an anti-rotation mechanism;

the pouring spout is equipped with a push-in inhibiting mechanism;

the push-in inhibiting mechanism prevents that the pouring spot is pushed in too deeply into the pouring neck or even drops into it, the tubular segment as well as the sickle-shaped bottom wall are each formed with at least one ventilation opening for incoming air in a controlled doses, the partly closing partition wall extends in pouring direction, the partition wall extends approximately up to the upper ventilation bore, and the partition wall forms a flow tear-off edge at the upper end.

In an embodiment for a 20 liter canister, the pouring spout has an outer diameter of 48 mm at the ring-shaped upper part and overall has a height (or length) of 52 mm. The inner partition wall projects "only" by about 6 mm into the pouring cross section and has a height (or length) of 27 mm. The upper ventilation bore has a diameter of about 5 mm, and the lower ventilation bore has a diameter of about 9 mm. The ventilation bores for the third stage in the bottom wall have a diameter of about 3 to 4 mm. The plastic material of the pouring spout is HD-PE. Since the air trap is very narrow in radial direction, but extends in circumferential direction approximately over half the circumference (180°), the partition wall projects only very slightly inwardly. In this way, a comparably large free cross section remains, which allows a filling of canisters with already installed pouring spouts in automatic bottling plants, when the fill pipe of the bottling plant has a tip of slightly smaller diameter.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A pouring spout for a liquid container, comprising:

a ring-shaped upper part for placement in a pouring neck of a liquid container;

a tubular seament attached to the ring-shaped upper part and extending approximately in prolongation of the ring-shaped upper part downwards into the pouring neck, said tubular segment having at least one opening for permitting air to enter; and a partition wall extending on an inner side of the tubular segment in substantial parallel relationship to the tubular segment and connected laterally with the tubular segment, said partition wall having an upper part distal bottom wall for connection to the tubular segment, wherein the partition wall and the tubular segment are each outwardly curved, said partition wall having a radius of curvature which is approximately the same as or slightly greater than a radius of curvature of the tubular segment.

2. The pouring spout of claim 1, wherein the partition wall extends in a pouring direction and is configured in the form of a tubular segment.

3. The pouring spout of claim 1, wherein the partition wall has an upper rim to form a flow tear-off edge and extends to a lower edge of the pouring neck of the container.

4. The pouring spout of claim 1, and further comprising a push-in inhibiting mechanism to prevent the pouring spout from being pushed-in into the container.

5. The pouring spout of claim 4, wherein the upper part is provided with a flanged rim projecting radially outwards for engagement in a recess of the pouring neck of the container to thereby implement the push-in inhibiting mechanism.

6. The pouring spout of claim 1, and further comprising a conical gradation positioned between the upper part and the tubular segment to realize a press-fit of the pouring spout in the pouring neck, wherein the opening of the tubular segment is configured as a vertical slot which extends upwards almost to the conical gradation and downwards to bottom wall.

7. The pouring spout of claim 1, wherein the bottom wall has a sickle-shaped configuration.

8. The pouring spout of claim 7, wherein the sickle-shaped bottom wall has at least two ventilation bores.

9. The pouring spout of claim 1 in the form of an injection molded plastic part having a greatest diameter which is greater by about 2% to 4% than an inner opening diameter of the pouring neck of the container.

10. The pouring spout of claim 9, wherein the injection-molded plastic part is made from HD-PE.

11. A pouring spout for a liquid container, comprising:

a ring-shaped upper part for placement in a pouring neck of a liquid container;

a tubular segment attached to the ring-shaped upper part and extending approximately in prolongation of the ring-shaped upper part downwards into the pouring neck, said tubular segment having at least one opening for permitting air to enter; and a partition wall extending on an inner side of the tubular segment in substantial parallel relationship to the tubular segment and connected laterally with the tubular segment, said partition wall having an upper part distal bottom wall for connection to the tubular segment; and an anti-rotation mechanism for preventing a rotation of the pouring spout relative to the pouring neck of the container.

12. The pouring spout of claim 11, wherein the upper part includes an outer slot for engagement by a projection jutting out inwardly from the pouring neck to thereby implement the anti-rotation device.

13. A pouring spout for a liquid container, comprising:

a ring-shaped upper part for placement in a pouring neck of a liquid container;

a tubular segment attached to the ring-shaped upper part and extending approximately in prolongation of the ring-shaped upper part downwards into the pouring neck, wherein the tubular segment includes two openings in vertical superimposed disposition, thereby defining a lower ventilation opening and an upper ventilation opening, wherein the lower ventilation opening has a diameter which is greater than a diameter of the upper ventilation bore; and a partition wall extending on an inner side of the tubular segment in substantial parallel relationship to the tubular segment and connected laterally with the tubular segment, said partition wall having an upper part distal bottom wall for connection to the tubular segment.

14. The pouring spout of claim 13, and further comprising two vertical intermediate walls extending between the partition wall and the tubular segment to define two outer chambers and a center chamber, wherein the intermediate walls as well as the partition wall extend in the area of the outer chambers to about a lower edge of the upper part, while the partition wall extends in the area of the center chamber to about the lower edge of the pouring neck and up to the upper ventilation opening.

15. The pouring spout of claim 14, wherein the partition wall extends inwardly by about 6 mm.

16. The pouring spout of claim 13 for use with a 20 liters canister, wherein the upper part has an outer diameter of 48 mm, with the pouring spout having an overall vertical dimension of 52 mm, wherein the partition wall has a vertical dimension of 27 mm, wherein the upper ventilation bore has a diameter of about 5 mm, and the lower ventilation bore has a diameter of about 9 mm.

17. The pouring spout of claim 13, wherein the bottom wall has at least two ventilation bores, wherein the ventilation openings in the tubular segment and the ventilation bores in the bottom wall are so positioned that in an initial pouring stage, in which the container is tilted slightly, air is able to enter through the upper ventilation opening as a main pouring stream is thrown out through the upper part while a small amount of liquid is able to flow also through the lower ventilation opening, that in a second pouring stage upon further tilting of the container to about 90° air enters through both the upper and lower ventilation openings while liquid is able to flow also through the ventilation bores in the bottom wall along an inner side of the partition wall for subsequent union with the main pouring stream, and that in a final pouring stage in which the container is tilted to about 120°, air is drawn also through the ventilation bores in the bottom wall.

18. A pouring spout for a liquid container, comprising:

a ring-shaped upper part for placement in a pouring neck of a liquid container;

a tubular segment attached to the ring-shaped upper part and extending approximately in prolongation of the ring-shaped upper part downwards into the pouring neck, said tubular segment having at least one opening for permitting air to enter; and a partition wall extending on an inner side of the tubular segment in substantial parallel relationship to the tubular segment and connected laterally with the tubular segment, said partition wall having an upper part distal bottom wall for connection to the tubular segment, wherein the partition wall extends in circumferential direction approximately over 180° of the tubular segment so that the partition wall projects only slightly inwardly in a radial direction so as to maintain a greatest possible free cross section for filling purposes.

19. The pouring spout of claim 18, wherein the partition wall extends inwardly in the radial direction by about 6 mm.

* * * * *